United States Patent [19]

Sisson et al.

[11] 4,427,152

[45] Jan. 24, 1984

[54] PRESSURE TIME CONTROLLED UNIT INJECTOR

[75] Inventors: Albert E. Sisson, Farmington; Donald J. Lewis, Troy, both of Mich.

[73] Assignee: The Bendix Corporation, Southfield, Mich.

[21] Appl. No.: 282,629

[22] Filed: Jul. 13, 1981

[51] Int. Cl.[3] ..... F02M 47/00

[52] U.S. Cl. ..... 239/90; 123/502; 239/95

[58] Field of Search ..... 239/88–92, 239/95, 96, 533.2–533.11; 123/450, 456, 472, 499–502

[56] References Cited

U.S. PATENT DOCUMENTS

| | | | |
|---|---|---|---|
| 3,921,604 | 11/1975 | Links | 123/499 X |
| 3,951,117 | 4/1976 | Perr | 123/450 X |
| 4,235,374 | 11/1980 | Walter et al. | 239/91 X |
| 4,281,792 | 8/1981 | Sisson et al. | 239/91 X |

*Primary Examiner*—Andres Kashnikow

*Attorney, Agent, or Firm*—Markell Seitzman; Russel C. Wells

[57] ABSTRACT

A fuel injector is provided for each cylinder of an internal combustion engine, the injector including an electronically operated control valve disposed between supply passage and a timing chamber to control the admission of fuel into and out of the timing chamber. A primary pumping piston and a secondary floating piston are axially spaced within the central bore of the injection body, and a normally closed injection nozzle is situated at one end of the injector body. A mechanical linkage associated with the camshaft of the engine drives the primary pumping piston against the bias of a main spring. The timing chamber is defined between the pistons and a metering chamber is defined between the secondary piston and the nozzle. An electronic control unit responds to engine operating conditions, and delivers a signal to the control valve to close the valve and seal the timing chamber for a controlled period of time to form a hydraulic link so that the pistons move in concert during the injection and metering phases of the cycle of operation. When the signal from the ECU is terminated, the control valve opens, and breaks the link so that the primary piston moves independently of the second piston. The timing function can be adjusted by the ECU relative to any preselected position of the crankshaft to optimize engine performance. The metering function is controlled by the pressure drop across a restricting orifice in the passageway feeding fuel to the metering chamber. The flow rate through the metering orifice is proportional to the square root of the pressure drop across the orifice.

11 Claims, 2 Drawing Figures

PRESSURE TIME CONTROLLED UNIT INJECTOR

CROSS-REFERENCE TO RELATED APPLICATIONS

This Application is related to the commonly assigned U.S. Pat. No. 4,281,792 filed Jan. 25, 1979. The specification, drawings and claims of this patent are specifically incorporated herein by reference and made a part hereof.

BACKGROUND OF THE INVENTION

1. Field of the Invention

The instant invention relates generally to fuel injection systems, and more particularly to injectors having a restricting orifice and an electronically operated control valve for regulating the quantity of fuel dispensed by each injector within a fuel injection system, the control valve also adjusting the timing of the dispensing of fuel in dependence upon various engine parameters.

2. Background Patents

Fuel injectors that are driven mechanically from the crankshaft of an internal combustion engine to deliver fuel into the cylinders of an internal combustion engine are well known; see, for example, U.S. Pat. No. 2,997,994, granted Aug. 29, 1961 to Robert F. Falberg. The movement of the crankshaft is translated into a force that periodically depresses the pump plunger via a cam, cam follower, and rocker arm mechanism. Since the rotation of the crankshaft reflects only engine speed, the frequency of the fuel injection operation was not adjustable with respect to other engine operating conditions. To illustrate, at cranking speeds, at heavy loads, and at maximum speeds, the timing and the metering (quantity) function for the fuel injector did not take into account actual engine operating conditions.

In order to enable adjustments to be made in the timing of the fuel injection phase of the cycle of operation, Falberg proposed that a fluid pressure pump 40 introduce fluid into a follower chamber 37 to elevate a plunger 35 and thus alter the position of push rod 6 which operates plunger member 12 of the fuel injector. By selecting the effective area of the plunger, the elevation thereof advances the plunger member relative to the desired point in the cycle of engine operation. The fluid pressure pump is driven by the internal combustion engine, and a lubricating oil pressure pump is frequently utilized as the fluid pressure pump.

U.S. Pat. No. 3,859,973, granted Jan. 14, 1975 to Alexander Dreisin, discloses a hydraulic timing cylinder 15 that is connected to the lubricating oil system for hydraulically retarding, or advancing, fuel injection for the cranking and the running speeds of an internal combustion engine. The hydraulic timing cylinder is positioned between the cam 3 which is secured to the engine crankshaft and the hydraulic plunger 38. The pressure in the lubrication oil pump 160 is related to the speed of the engine 1, as shown in FIG. 1.

U.S. Pat. No. 3,951,117, granted Apr. 20, 1976 to Julius Perr, discloses a fuel supply system including hydraulic means for automatically adjusting the timing of fuel injection to optimize engine performance. The embodiment of the system shown in FIGS. 1–4 comprises an injection pump 17 including a body 151 having a charge chamber 153 and a timing chamber 154 formed therein. The charge chamber is connected to receive fuel from a first variable pressure fuel supply (such as valve 42, passage 44, and line 182), and the timing chamber is connected to receive fuel from a second variable pressure fuel supply over line 231, while being influenced by pressure modifying devices 222 and 223. The body further includes a passage 191 that leads through a distributor 187 which delivers the fuel sequentially to each injector 15 within a set of injectors.

A timing piston 156 is reciprocally mounted in the body of the injection pump in Perr between the charge and timing chambers, and a plunger 163 is reciprocally mounted in the body for exerting pressure on fuel in the timing chamber. The fuel in the timing chamber forms a hydraulic link between the plunger and the timing piston, and the length of the link may be varied by controlling the quantity of fuel metered into the timing chamber. The quantity of fuel is a function of the pressure of the fuel supplied thereto, the pressure, in turn, being responsive to certain engine operating parameters, such as speed and load. Movement of the plunger 163 in an injection stroke results in movement of the hydraulic link and the timing piston, thereby forcing fuel into the selected combustion chamber. The fuel in the timing chamber is spilled, or vented, at the end of each injection stroke into spill port 177 and spill passage 176. The mechanically driven fuel injector, per se, is shown in FIGS. 14–17.

All of the above-described fuel injection systems employ hydraulic adjustment means to alter the timing of the injection phase of the cycle of operation of a set of injectors mechanically driven from the crankshaft of an internal combustion engine, and the hydraulic means may be responsive to the speed of the engine and/or the load imposed thereon. While the prior art systems functioned satisfactorily in most instances, several operational deficiencies were noted. For example, the hydraulic adjustment means functioned effectively over a relatively narrow range of speeds, and responded rather slowly to changes in the operating parameters of the engine. Also, problems were encountered in sealing the hydraulic adjustment means, for a rotor-distributor pump was utilized to deliver hydraulic fluid to each of the fuel injectors in the set employed within the fuel injection system. In order to provide a hydraulic adjustment means responsive to both speed and/or the load factor, as suggested in the Perr patent, an intricate, multicomponent assembly is required, thus leading to high production costs, difficulty in installation and maintenance, and reduced reliability in performance.

SUMMARY OF THE INVENTION

Thus, with the deficiencies of the known fuel injection systems, it is an object of the instant invention to employ one electronically operated control valve for each injector utilized within a fuel injection system. Each control valve, in response to a signal pulse from an electronic control unit, controls the timing of the injection phase for the injector, and also controls the duration of metering of fuel into the metering chamber, the quantity of fuel being a function of the pressure drop across a restrictive orifice and the duration of metering.

Furthermore, it is another object of the instant fuel injection system to utilize existing electronic control units (ECU), such as the ECU described in Ser. No. 945,988, filed Sept. 25, 1978, now U.S. Pat. No. 4,379,332 and incorporated by reference herein, which respond rapidly to several engine parameters in addition to engine speed and load, and generate appropriate signals for the control valve associated with each fuel injector. The signals developed by the ECU are delivered to the control valve in synchronism with angle of rotation of a rotating member of the engine.

Yet another object of the instant invention is to provide a simple, compact, yet reliable, electronically operated control valve that regulates the timing function and controls the time aspect of a pressure-time metering function of a fuel injector. The metering function is proportional to the period that the control valve is retained in its closed condition by an electrical signal from the electronic control unit in conjunction with the amount of pressure drop across an orifice in series with the flow of fuel into the metering chamber.

These, and several other objects, are realized in a fuel injector utilizing a primary pumping piston and a secondary floating piston disposed within its central bore. An electronically operated control valve selectively forms a hydraulic link between the pistons so that they move in unison because of the vacuum formed in the timing chamber during the injection and metering phases of the cycle of operation. At other times, the secondary piston is fixed and the primary piston moves independently thereof. A novel method of operating the fuel injector to form a hydraulic link between the pistons is also an integral part of the instant invention.

yet additional objects of the invention, and advantages thereof in relation to known fuel injectors and fuel injection systems, will become readily apparent to the skilled artisan when the specification is construed in harmony with the following drawings in which:

DESCRIPTION OF THE PREFERRED EMBODIMENT OF THE INVENTION

Figure 1:
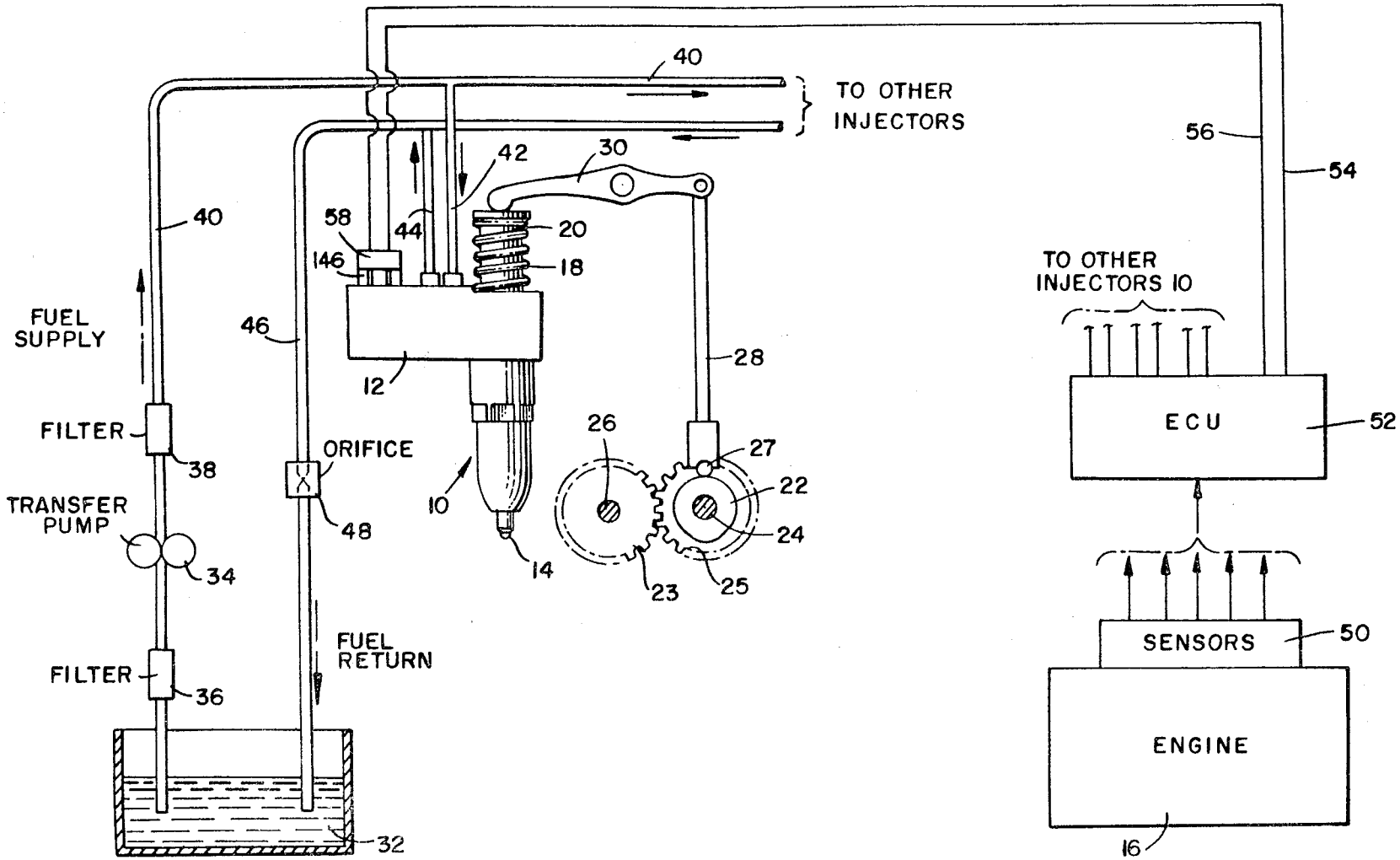
FIG. 1 is a schematic diagram of a fuel injection system configured in accordance with the principles of the instant invention.

Turning now to the drawings, FIG. 1 schematically depicts the major components of a fuel injection system employing an electronically operated control valve for regulating the timing function, and the time portion of a pressure-time metering function of each injector within the system. The system includes a fuel injector 10 supported by a support block 12 and is controlled to deliver fuel through a nozzle 14 directly into the combustion chamber (not shown) of an internal combustion engine 16. Although only one injector is shown, it should be noted that a set of identical injectors is employed within the fuel injection system, one injector being provided for each cylinder in the engine. The injector 10 is operated in synchronism with the operation of the engine through the reciprocal actuation of a follower 20, the follower 20 being biased upwardly by a heavy duty spring 18.

A cam 22 is secured to the camshaft 24 of the internal combustion engine 16. Cam 22 rotates at a speed which is a function of engine speed, for the camshaft is driven via meshing gears 23, 25 from the crankshaft 26. The gear ratio of gears 23, 25 may vary from engine to engine depending on various factors, including, inter alia, whether the engine is a two-cycle or four-cycle engine. The crankshaft drives the pistons (not shown) within the combustion chambers of the engine 16 in the usual manner. A roller 27 rides along the profile of the cam, and a push rod 28 and rocker arm 30 translate the movement of the follower into the application of axially directed forces upon the follower 20 and the primary piston; the forces acted in opposition to main spring 18 and vary in magnitude with the speed of the engine and the profile of the cam.

A reservoir 32 serves as a source of supply for the fuel to be dispensed by each injector 10, and fuel is withdrawn from the reservoir by transfer pump 34. Filters 36, 38, remove impurities in the fuel, and distribution conduit 40 introduces the fuel, at supply pressure, to each of the injectors 10. A branch conduit 42 extends between distribution conduit 40 and block 12 and makes fuel, at supply pressure, available for circulation through injector 10. The fuel that is not dispensed into a combustion chamber in the engine is returned to the reservoir 32 via branch return conduit 44 and return conduit 46. A fixed orifice 48 is disposed in return conduit 46 to control rate of return flow into the reservoir. Directional arrows and legends adjacent to the conduits indicate the direction of fuel flow.

The fuel injection system of FIG. 1 responds to several parameters of engine performance. In addition to engine speed, which is reflected in the rate of rotation of the cam 22 secured upon camshaft 24, several sensors 50 are operatively associated with engine 16 to determine, inter alia, engine speed, temperature, manifold absolute pressure, load on the engine, altitude, and air-fuel ratio. The sensors 50 generate electrical signals representative of the measured parameters, and deliver the electrical signals to the electronic control unit, or ECU 52. The electrical control unit then compares the measured parameters with reference values which may be stored within a memory in the unit, takes into account the rotational speed and angular position of cam 22, and generates a signal to be delivered to each injector. The signal, in turn, governs the timing and at least a portion of the metering functions of each injector. Leads 54, 56 and a connector 58 interconnect the electronic control unit 52 and a control valve 60 for the representative injector shown in FIG. 1.

Figure 2:
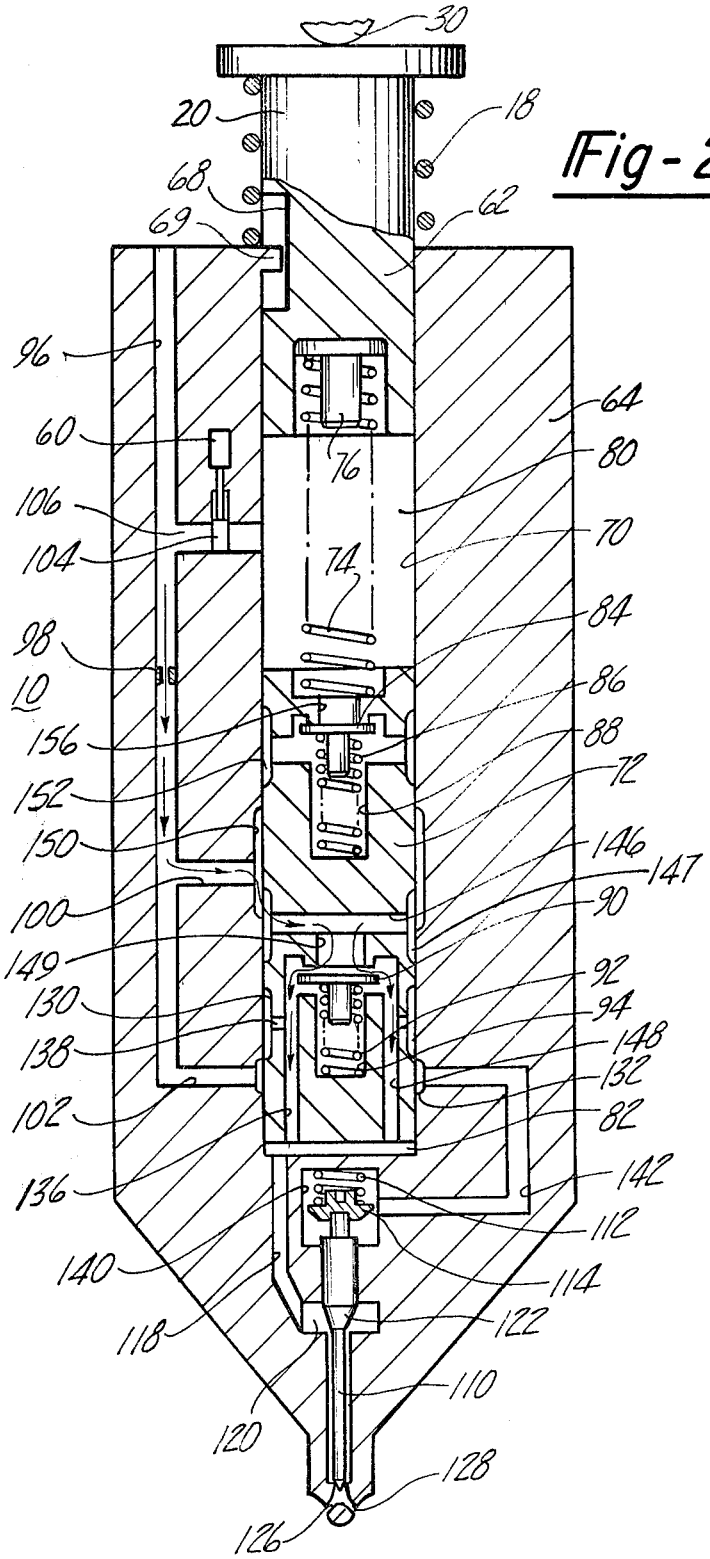
FIG. 2 is a vertical cross-sectional view, on an enlarged scale, of a fuel injector utilized within the system of FIG. 1 and incorporating the features of the present invention.

Referring now to FIG. 2 there is schematically illustrated the components of a representative injector 10. For a complete description of the operation of injector 10, reference is made to the specification and drawings of the above-reference Application Ser. No. 6,948.

The injector 10 includes a body member 64 and, at the upper end of the injector 10, a fragment of the rocker arm 30 is illustrated bearing against the enlarged end of follower 20. Main spring 18 rests on support block 12 (FIG. 1) and urges the follower 20 upwardly. A primary pumping piston 62 is joined to the lower end of follower 20, the follower 20 and primary pumping piston 62 moving as a unitary member. A slot 68 cooperates with a stop 69 to prevent the follower 20 and spring 18 from becoming disassembled from the injector body 64 prior to association with the cam 30 and to limit the downward travel of follower 20.

The body member 64 is provided a central bore 70 which is adapted to receive the lower end of the primary pumping piston 62 and also receives a secondary floating piston 72, the primary piston 62 and the floating piston 72 being separate and urged away, one from the other, by means of a spring 74. The upper end of spring 74 is mounted on a stud 76 which is supported in a cavity formed in the bottom of primary piston 62. The lower end of spring 74 rest in a cavity formed in the end of secondary floating piston 72. The cavity formed between the lower end of primary pumping piston 62 and the upper end of secondary floating piston 72 forms a timing chamber 80. The bottom of bore 70 and the bottom of secondary floating piston 72 forms the metering chamber 82, the amount of fluid contained within metering chamber 82 during any preinjection portion of the engine cycle being determined by a pressure-time metering concept as will be more fully explained hereafter.

The secondary piston 72 is provided a control valve 84 which is shown in the close position, the valve 84 being held in the close position by means of a spring 86. The spring 86 is contained within a cavity 88 formed in the interior of secondary piston 72. The floatiing piston 72 is provided with a second control valve 90, the control valve 90 being retained in the closed position by means of a spring 92 contained within a cavity 94.

As will be seen from a description of the operation of injector 10, the valve 84 is used to control or limit the downward motion of floating piston 72. The valve 90 is used to control the flow of fuel into the metering chamber 82 during the upward travel of floating piston 72.

Fuel is fed to injector 10 by means of a main passageway 96 formed in body 64, the passageway 96 containing a restrictive orifice forming element 98, (reference numeral 98 also includes the orifice) the orifice of which has been carefully selected to meet the required engine operation. The flow rate of fuel through the orifice is proportional to the square root of the pressure drop across the orifice. The pressure drop is proportional to the pressure of the fuel being supplied passage 96. The pressure of the fuel may be varied to accomodate engine variables. For example, the pressure may be lowered for a low speed operation.

Fuel is permitted to flow through the restricting orifice 98 to the control valve 90 by means of a passageway 100 and pressure is relieved from the metering chamber and the injector tip by means of a passageway 102. The functions of these various passages will be explained when a description of the operation of injector 10 proceeds. Primary control of the operation of the injectors achieved by means of the electromagnetic control solenoid 60 which is utilized to operate a valve member 104. The valve member is utilized to control the flow of fluid through a passageway 106.

Upon downward movement of the floating piston 72, and thus compression of the fuel in metering chamber 82, the tip of injector 10 is pressurized. The injector 10 includes a needle valve 110 which is biased downwardly or in the closed position by means of a spring 112 acting on a stabilizing and guide element 114. The pressurizing of metering chamber 82 pressurizes a passageway 118 which in turn pressurizes chamber 120. The pressurization of chamber 120 acts on a surface 122 which causes upward movement of the needle valve 110 due to the greater area of surface 122 relative to the needle portion of the valve 110. Upon opening of valve 110, fluid flows from orifices 126, 128. At such time as a grooved area 130 formed in piston 72 overlaps a second grooved area 132 formed in the central bore 70, the pressure in the metering chamber 82 is relieved by means of fuel flow through passageway 136 and a passageway 138. This also relieves the pressure at the tip of injector 10, particularly in chamber 120 to permit the injector to close under the influence of spring 112.

The upward movement of the needle valve 110 slightly pressurizes the chamber 140, which pressure is relieved by means of a passage 142 which is also connected to groove 132.

During the metering portion of the cycle, fuel flows through restricting orifice 98, through passageway 100, annulus 147, cross-hole or passageway 146 and an axial passageway 149 to open valve 90. Fuel then flows to the metering chamber 82 through the passageway 136 and a passageway 148.

Describing now the operation of the injector 10, and assuming that the injector is in the position shown in FIG. 2, that is, the metering phase of operation period. During the metering phase, the piston 20 is in its upward travel due to the fact that the rocker arm 30 is lifting. In this situation, the valve 84 is closed valve 90 is open, and the solenoid 60 is operated such that the valve 104 is closed. With the upward travel of primary piston 20, a low pressure is created in timing chamber 80 thus drawing secondary floating piston 72 upwardly. This creates a reduced pressure in metering chamber 82 thereby creating a pressure drop across valve 90, thus opening the valve. Accordingly, fuel will flow through passage 96, restrictive orifice 98, passage 100, valve 90 and passages 136, 148 and into metering chamber 82. However, with the restrictive orifice 98, the fuel cannot fill metering chamber 82 as fast as piston 72 is rising. Thus, the void created will be filled with fuel vapor.

It is to be understood that the amount of fuel flowing into the metering chamber 82 is a function of the amount of time that the valve 104 is closed during the upward movement of piston 72. The closed condition of valve 104 creates a hydraulic link between primary piston 20 and floating piston 72 to draw floating piston 72 upwardly and the amount of fuel flowing through the orifice forming element 98 which is a function of the pressure differential across the orifice 98.

When sufficient fuel has been drawn into metering chamber 82, as determined by the electronic control unit, the valve 104 is opened by means of solenoid 60. This permits fuel to flow through passages 96, 106 into the timing chamber 80. This flow of fuel into timing chamber 80 causes secondary piston 72 to stop and permits primary piston 62 to move upwardly to the full extent of travel permitted by stop 69 under the force of spring 18.

Now the rocker 30 is driven downwardly to cause primary piston 62 to move down. This causes fuel in timing chamber 80 to flow out of timing chamber 80 through passages 106 and 96. When the electronic control unit determines that injection is to take place, the valve 104 is closed by means of solenoid 60 to create the hydraulic link between primary pistons 62 and floating piston 72. This causes timing chamber 80 to be pressurized and drives floating piston 72 downwardly. This downward motion pressurizes metering chamber 82 and chamber 120 thereby opening the valve 110. Upon opening valve 110 fuel is squirted into the engine.

As such time that groove 132 overlaps with groove 130, fuel will flow out of metering chamber 82 through passages 136, 148 and passage 138 to relieve the pressure in the metering chamber 82. This, in turn, relieves the pressure in chamber 120 to permit needle valve 110 to close. Further downward movement causes grooves 150 formed on the interior surface of bore 70 and groove 152 formed on the exterior surface of secondary piston 72 to overlap. When these grooves overlap, further downward travel of primary piston 62 opens valve 84 to permit fuel to flow through a passageway 156, through valve 84, and out through the passage 100. This permits the complete downward travel of piston 62 in response to the downward movement of the rocker arm 30. It will be recalled that the valve 104 is still in the closed position.

With secondary piston 72 in its downmost position, and primary piston 62 similarly situated in its downmost position, the rocker 30 starts an upward movement to permit primary piston 62 to be moved upwardly in response to the force of spring 18. This brings the operation back to the metering phase of operation as was described earlier.

While a preferred embodiment has been illustrated and described, it is to be understood that many other modifications could be made to the preferred embodiment without departing from the spirit and scope of the following claims.

We claim:

1. A fuel injector for an internal combustion engine comprising:

a body having an axially extending bore;

a primary pumping piston and a secondary piston positioned within said body for axial movement therein;

a nozzle situated at the end of said bore remote from said primary pumping piston;

a timing chamber defined in said body between said primary pumping piston and said secondary piston;

a metering chamber defined in said body between said secondary piston and said nozzle;

passages in said body of said injector for receiving pressurized fuel and transmitting said fuel into said timing chamber and said metering chamber characterized in that said fuel injector further comprises:

means for controlling (1) the timing of the discharge of fuel from the metering chamber through the nozzle and (2) the quantity of fuel stored in said metering chamber subsequent to said discharge of fuel in accordance with a pressure-time function including an electronically operated control valve for controlling the flow of fuel among said passages, said timing chamber, and said metering chamber; and said controlling means further including a restrictive orifice in at least one of said passages leading to said metering chamber for restricting the flow into said metering chamber and for reducing in cooperation with said secondary piston, the pressure in said metering chamber to the vapor pressure of the fuel during the time that fuel is permitted to flow to said metering chamber.

2. A fuel injector as defined in claim 1 wherein said electronic control valve controls the admission of fuel at supply pressure into said timing chamber creating a hydraulic link between said primary piston and secondary piston to selectively hydraulically connect said primary pumping piston and said secondary piston.

3. A fuel injector as defined in claim 2 wherein said electronic control valve is at one of a closed or open state to create a pressure equilibrium condition in said timing chamber to permit independent movement of said primary pumping piston relative to said secondary piston during a portion of the operation of the injector.

4. A fuel injector as defined in claim 3 further including spring means situated in said central bore for biasing the secondary piston toward said nozzle.

5. A fuel injector as defined in claim 4 wherein the lower end of said primary pumping piston has a cavity defined therein and the upper end of said secondary piston has a recess defined therein, the opposite ends of said spring means being seated in said cavity and said recess.

6. A fuel injector as defined in claim 2 further including a first check valve interconnected to control fuel flow between said timing chamber and said passages for periodically eliminating said hydraulic link between said primary pumping piston and said secondary piston.

7. A fuel injector as defined in claim 6 wherein said first check valve is unseated to release fuel from said timing chamber into said passages when the secondary piston approaches its most downward position.

8. A fuel injector as defined in claim 1 wherein said secondary piston has elongated axially extending passages defined in its lower end, said passages opening at one end into said metering chamber, and said passages momentarily dumping fuel at high pressures back into said axial passages when the injection phase of the cycle of operation is terminated.

9. A fuel injector as defined in claim 8 wherein said secondary piston has an annulus defined near its midsection, said annulus leading into a cross-hole which communicates with a short axial passage, said short axial passage communicating with said elongated axially extending passages that open into said metering chamber, a check valve, and a spring to normally bias said check valve against its seat to prevent communication between said annulus and said metering chamber, said check valve being unseated only during the metering phase of the cycle of operation to allow fuel at supply pressure in the axial passages to enter the annulus and proceed downwardly into the metering chamber.

10. A fuel injector as defined in claim 1 wherein the volumes of said timing chamber and said metering chamber are varied during the cycle of operation of said fuel injector.

11. A fuel injector as defined in claim 10 wherein a portion of said operation is metering and said metering chamber volume is varied linearly during said metering portion.

* * * * *